US005205089A

United States Patent [19]

Cunningham

[11] Patent Number: 5,205,089

[45] Date of Patent: Apr. 27, 1993

[54] PORTABLE SHELTER ASSEMBLY

[76] Inventor: Matthew S. Cunningham, 2 Woodland Rd., Dover, N.H. 03820

[21] Appl. No.: 815,505

[22] Filed: Jan. 2, 1992

[51] Int. Cl.[5] ..... E04H 1/12

[52] U.S. Cl. ..... 52/79.1; 52/79.5; 135/88; 135/102; 135/106; 135/113

[58] Field of Search ..... 135/88, 102, 103, 106, 135/116, 113; 52/67-69, 79.1, 79.5

[56] References Cited

U.S. PATENT DOCUMENTS

| | | | |
|---|---|---|---|
| 2,863,178 | 12/1958 | Hagen | 52/69 |
| 3,742,966 | 7/1963 | Franzen | 135/88 |
| 4,271,856 | 6/1981 | Ferguson . | |
| 4,830,036 | 5/1989 | Sanders | 135/88 |

FOREIGN PATENT DOCUMENTS 989081 4/1965 United Kingdom .

*Primary Examiner*—James L. Ridgill, Jr.
*Attorney, Agent, or Firm*—Robert G. Crooks

[57] ABSTRACT

This portable shelter assembly includes a weather-proof container suitable to be mounted on a pair of support bars atop a vehicle. When the vehicle is at a stand still and the shelter assembly is to be made ready for occupancy, the container unfolds to become a deck or platform on which the occupants can sleep. Attached to the deck are a pair of arch members hingedly connected thereto and a folding arch member having knee joints so that all can collapse into the container or be erected to support a tent canopy to shelter the occupants. The shelter assembly should be balanced atop the vehicle, both in its collapsed and its erected positions.

Various means are provided for fastening the shelter assembly to the vehicle. The tent may have associated therewith a screen house for protection against insects.

12 Claims, 7 Drawing Sheets

PORTABLE SHELTER ASSEMBLY

This invention relates to a portable shelter assembly to be mounted atop an automotive vehicle. The assembly includes a tent which can be furled and housed in an attractive container when the vehicle is under way, but which can be erected for the purpose of shelter when the vehicle is not under way. The erected tent provides comfortable sleeping accommodations atop the vehicle. Associated screen and shelter structures provide convenient living accommodations adjacent the vehicle when it is not in motion. The shelter assembly is configured in such a way that the weight of the shelter assembly and its occupants is well balanced and does not require support from undependable ground terrain or from unreliable accessories such as ladders.

BACKGROUND OF THE INVENTION

Many years ago, a proposal was made to mount a tent on a motor vehicle in such a way that it could be folded when the vehicle is under way but could be erected when the vehicle stopped and the occupants of the vehicle wished to have sleeping accommodations without leaving the vehicle. An arrangement of that nature is shown in British patent 989,081, published on Apr. 14, 1965 and based upon an earlier application filed in Italy on Mar. 7, 1961. The British patent shows a framework structure supporting the tent atop the motor vehicle. However, the framework leaves much to be desired in the way of strength. Moreover, the weight of the tent and its supporting structure is not balanced on the motor vehicle. One-half the weight of the tent and its supporting platform rests upon a flimsy ladder which may or may not have a firm footing on the ground. Further, when the tent and supporting structure are folded so that the vehicle can be under way, the folded assembly does not present an attractive, "aerodynamically clean" appearance of minimum width atop the vehicle.

Another prior-art approach to the problem of providing a portable shelter assembly is shown in U.S. Pat. No. 4,271,856, issued on Jun. 9, 1981 to Robert W. Ferguson. As in the case of the aforementioned British patent, Ferguson provides a two part hinged container for the tent. The container unfolds to form a flat deck when the tent is erected above a vehicle. However, there is no indication that the folding tent of Ferguson is balanced atop the vehicle. The mode of support of Ferguson's shelter assembly is not spelled out in his patent. The frame members which support the folding tent of Ferguson are external to the tent and are deployed in such a way that rain water would tend to gather around the frame members and also at the edges of the horizontal deck formed by the two parts of the hinged container.

A third prior-art approach to the problem of providing a portable tent for mounting on top of a vehicle is described in U.S. Pat. No. 4,830,036, granted on May 16, 1989 to Charles W. Sanders. The Sanders patent, once again, shows a platform that can be folded to form a container and unfolded to form a deck for the tent. Atop the deck are mounted a pair of hinged arch-like frames which in turn support a tent canopy of tubular form reminiscent of the fabric covers of the Conestoga wagons of pioneer history Sanders provides only a single pair of arch frames to support the tent canopy. Moreover, once again, the deck or platform on which the tent is mounted is not balanced on the vehicle which is to carry it. Rather, the weight of one-half of the tent platform, and of any persons reclining thereon, depends for its support upon a ladder which may or may not be sufficiently strong and well anchored to carry that burden Sanders does not show a tent container which is minimized in transverse cross section and which is "aerodynamically clean" so as to minimize aerodynamic drag when the vehicle is in motion. Thus it appears that the prior art, as represented by the three aforementioned patent references, is deficient in one or more important ways.

OBJECTS OF THE INVENTION

In view of the deficiencies of the prior-art portable shelter assemblies disclosed in the cited patent references, it is an object of my invention to provide a portable shelter assembly which, in its erected state, is sufficiently strong to bear safely the weight of its occupants and to resist the stresses that may be imposed upon it by adverse weather conditions such as gusty winds.

It is another object of my invention to provide a portable shelter assembly which, both in its folded state and in its erected state, is well balanced atop the vehicle on which it is mounted.

It is a further object of my invention to provide a portable shelter assembly which will furnish maximum possible space and "head room" under the tent of the shelter assembly.

It is a still further object of my invention to provide a portable shelter assembly that can be folded into a container which is pleasing in appearance and which will cause a minimum amount of aerodynamic drag when the vehicle on which it is mounted is in motion.

It is still another object of my invention to provide a portable shelter assembly that will "shed" rain water rather than gathering it into interstices adjacent the frame of the assembly or the platform upon which it rests.

SUMMARY OF THE INVENTION

Briefly, I have fulfilled the above-mentioned and other objects of my invention by providing a portable shelter assembly housed in a substantially rectangular container adapted to be mounted atop a vehicle. The lower portion, or floor, of the container serves also as a "deck" to support the occupants of the shelter assembly when it is in use for sleeping accommodations. The side and upper portions of the substantially rectangular container also fold down to form part of the sleeping deck when the shelter assembly is in use by its occupants. First and second arch members are hingedly connected to the aforementioned deck so that they can rotate into erected positions, preferably leaning slightly outward, for supporting the weatherproof tent canopy. Also supporting the tent canopy in its erected position is a folding arch member which is hingedly connected to the deck with its ends positioned between the respective corresponding ends of the aforementioned first and second arch members. The folding arch member has "knee joints" so that it can nest close to the floor of the container when the tent is furled and the portable shelter assembly is ready to be transported atop its vehicle.

Also attached to opposite ends of the central floor portion of the container are a pair of curved fairings which close the respective ends of the container when the shelter assembly is in transit. The fairings provide weatherproof closures for the container and also serve to minimize the aerodynamic drag of the container when it and the supporting vehicle are in motion. The fairings also serve as stiffeners for the lower portion of the tent canopy when it is in its erected position. The fairings can further serve as receptacles for small articles within the tent when it is in use by its occupants.

The portable shelter assembly in accordance with my invention is arranged to be carried on a pair of support bars which are fastened to the top of the vehicle on which the assembly is mounted. The support bars may be either square or round in cross section, and should be extensible at their ends by telescoping or otherwise. The extensions should be sufficient to support the side and upper portions of the container when they are unfolded into positions coplanar with the central floor portion of the container.

I also provide a "foot" for carrying each end of the support bars and for mounting them atop the vehicle. Each such foot may be secured to the top of the vehicle by means of a hook coupled to the rain gutter of the vehicle if it has one. Otherwise, the foot may be permanently attached to the vehicle by a bolt through the body of the vehicle.

Finally, my invention provides for a screen house to be associated with the erected shelter assembly to provide additional living space with protection against insects and other pests. The screen house is erected at the side of the vehicle and adjacent thereto.

BRIEF DESCRIPTION OF THE DRAWINGS

The invention summarized above will be described in detail in the following specification. The specification will be best understood if read while referring to the accompanying drawings in which.

DESCRIPTION OF THE PREFERRED EMBODIMENTS

Figure 1:
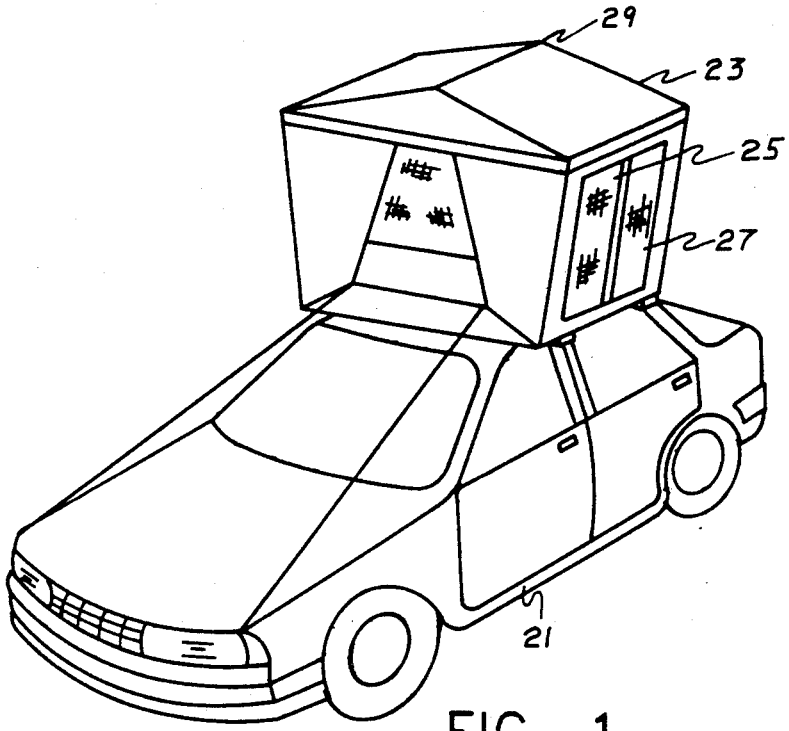
FIG. 1 is a perspective view of my portable shelter assembly in its erected position atop a motor vehicle.
Figure 8:
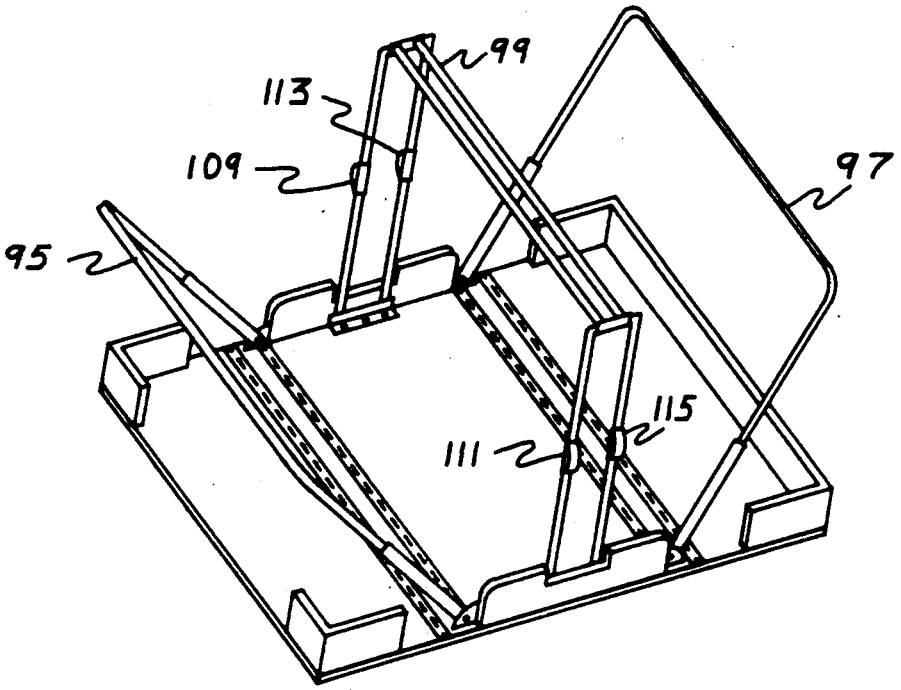
FIG. 8 is a perspective view of the "deck" formed by the central floor portion, the pair of side portions, and the pair of upper portions of the container when in their coplanar position, also including the first and second arch members hingedly connected to the aforementioned deck and the folding arch member connected hingedly to the deck intermediate the aforementioned first and second arch members.
Figure 9:
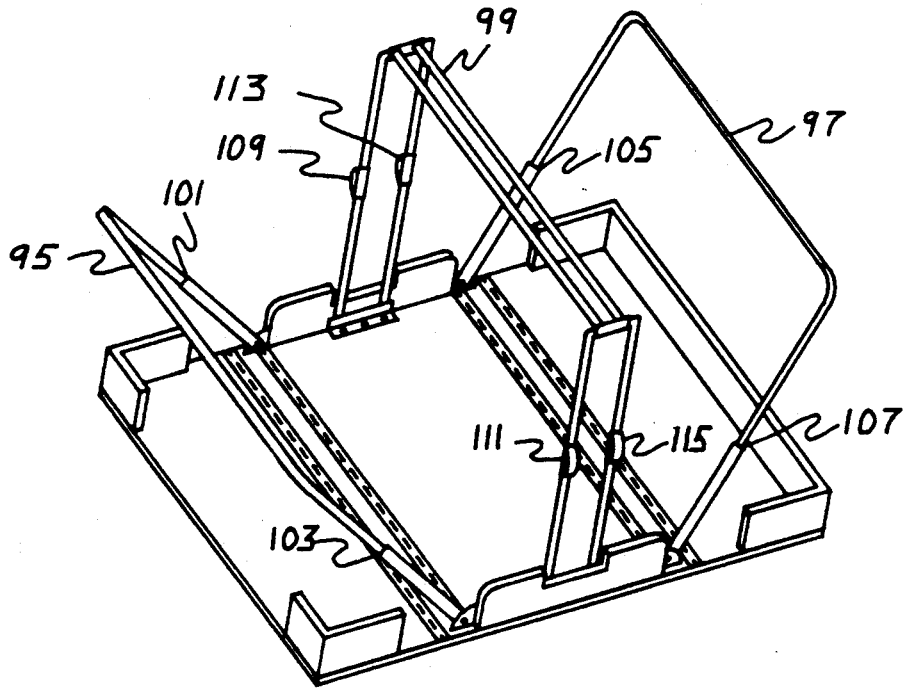
FIG. 9 is a perspective view of an assembly similar to that of FIG. 8 but in which provision is shown for telescoping the aforementioned first and second arch members and in which the partial walls at the respective ends of the central floor portion have rounded corners to facilitate rotary motion of the first and second arch members between their folded and erected positions and in which the aforementioned first and second arch members are hinged to the aforementioned partial walls at the respective ends of the central floor portion.

Turning to FIG. 1 of the drawings, we see a vehicle 21 upon which is mounted a tent canopy 23 in its erected position, ready for occupancy by its owners. Access to tent canopy 23 is afforded by means of first and second doors 25 and 27, or by a single door if desired, which may comprise simply a netting for excluding insects and other pests, if that is all that is required. First door 25 and second door 27 are shown for illustrative purposes on the side of tent canopy 23 corresponding to the left side of vehicle 21. However, the doors could equally well be on the riqht side of vehicle 21 or on the front or rear of tent canopy 23 if desired. As shown in FIG. 1 of the drawings, tent canopy 23 may be anchored to corners of vehicle 21 by four light but strong connections, such as nylon cord. It is noteworthy that tent canopy 23 has a "ridge" 29 which may be aligned with the fore-and-aft axis of vehicle 21, if desired. The existence of ridge 29 will become apparent after the discussion of a folding arch member which is illustrated in FIGS. 8 and 9 of the drawings.

Figure 2:
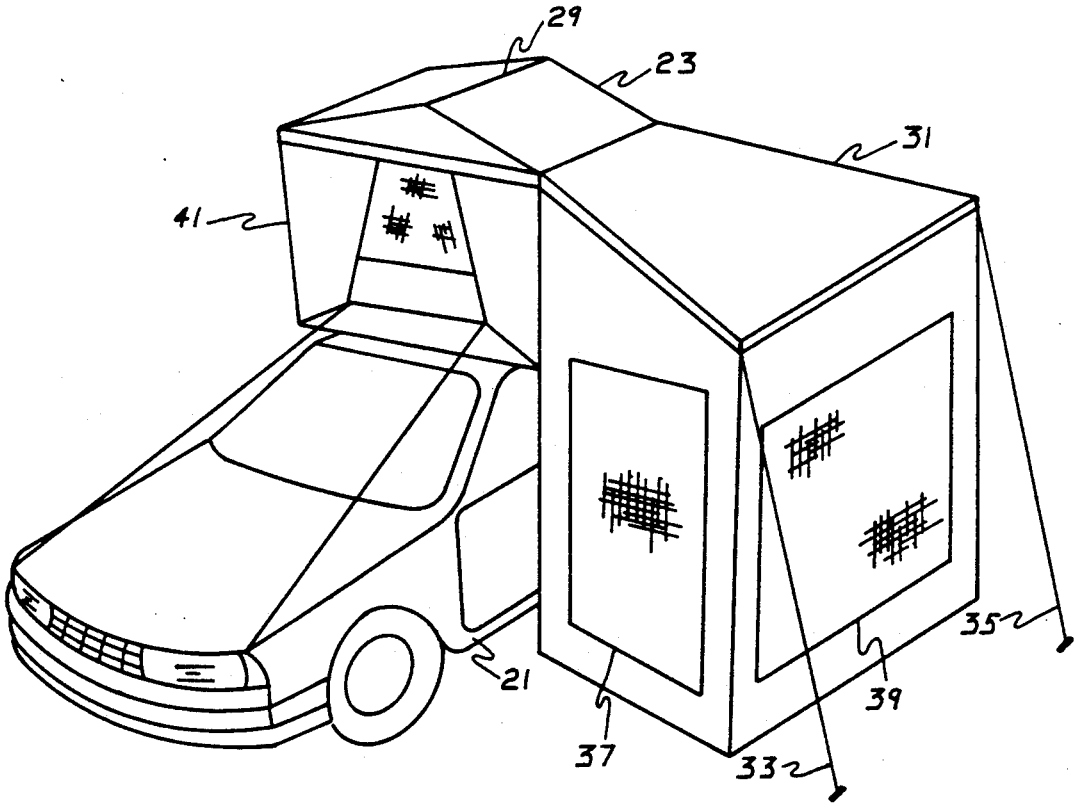
FIG. 2 is a perspective view of the motor vehicle, the tent in its erected position atop the motor vehicle, and an associated screen house beside the motor vehicle and coupled to the tent, being an optional part of the portable assembly in accordance with my invention.

FIG. 2 of the drawings illustrates an assembly similar to that of FIG. 1, to which has been joined on one side of vehicle 21 a screen house 31. It is desirable that screen house 31 should be joined to tent canopy 23 in such a way that the intersection is impervious to insects and other pests. On the outboard side, screen hose 31 may be anchored to the ground by first guy 33 and second guy 35, which are connected to stakes driven into the ground. Screen house 31 may be fabricated from nylon or other light and durable material that can be stored and carried with tent canopy 23 and unfurled when the owners wish to "set up camp." Access between tent canopy 23 and screen house 31 can be provided through first door 25 and second door 27, or through a single door if that is the preference of the owners.

Screen house 31 may incorporate a first screened window 37 and a second screened window 39 in order to permit the passage of light and air.

In FIG. 2, as in FIG. 1, it is apparent that one corner of tent canopy 23 is inclined outward in a direction from the floor towards the roof. Inclined corner 41 of FIG. 2 illustrates this desirable attribute. In order to provide maximum "head room" within tent canopy 23, it is desirable that all corners of tent canopy 23 should likewise be inclined outward in a direction from the floor towards the roof. However, if such outward inclination would interfere with a tight joint between tent canopy 23 and screen house 31, the side of tent canopy 23 which is to be adjacent screen house 31 could, if desired, be made vertical rather than outwardly inclined. In that way, the side of tent canopy 23 which is to mate with screen house 31 would be vertical so as to facilitate a tight joint between tent canopy 23 and screen house 31.

Figure 3:
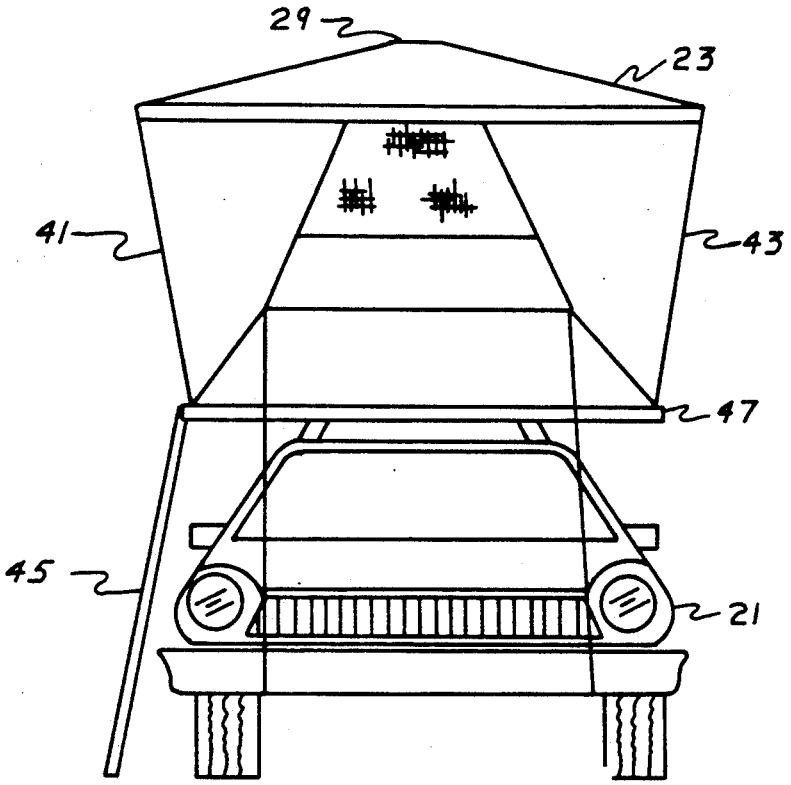
FIG. 3 is a front view of the motor vehicle with the tent in its erected position atop the motor vehicle.

FIG. 3 of the drawings again shows how first inclined corner 41 of tent canopy 23 "leans outward" to enhance the head room within tent canopy 23. The same figure likewise illustrates how the corresponding second inclined corner 43 of tent canopy 23 also leans outward symmetrically for the same purpose. Further, the front view of vehicle 21 and the portable shelter assembly shows graphically the way in which the portable shelter assembly, in its erected position, is balanced atop vehicle 21 without relying upon any extraneous support. At the left in FIG. 3 (the right-hand side of the vehicle) is shown a ladder 45. However, ladder 45 serves only to provide access to the portable shelter assembly, and is not necessary to support it. Instead, the entire weight of the shelter assembly is carried by a first support bar 47 and a second support bar 49 which are spaced from each other in a fore-and-aft direction as more graphically illustrated in FIG. 4 of the drawings. First support bar 47 and second support bar 49 may be of any of the types illustrated in FIGS. 13 through 16 of the drawings.

First support bar 47 and second support bar 49 should be made of steel or some other strong material. The bars may be covered with polyethylene or some other plastic material to protect them against rust and to prevent injury of the container being carried on the bars. Each bar may have a cross section that can be rectangular, as in FIGS. 13 and 15, or round, as in FIGS. 14 and 16 of the drawings. The round cross section has certain advantages over the rectangular cross section in that it may be somewhat stiffer and more resistant to bending in the direction that force is applied to the bar by the container.

Figure 14:
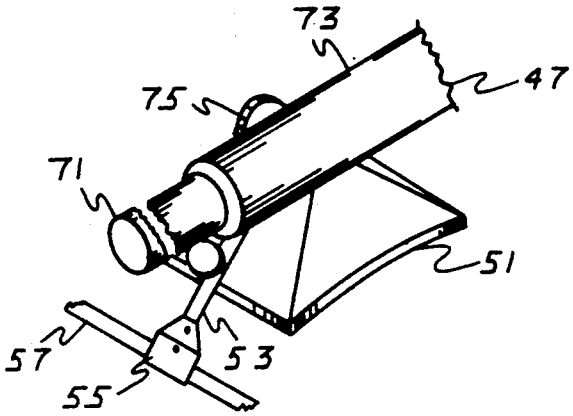
FIG. 14 is a perspective view of one end of a support bar in which a "foot" carries the support bar and rests upon the roof of the vehicle upon which the portable shelter assembly is mounted, showing also an anchor tying the support bar to the rain gutter of the vehicle and, further, in which the cross section of the support bar is round, rather than rectangular, as in the case of the support bar of FIG. 13.

A common and most satisfactory configuration for the underpinnings of first support bar 47 and second support bar 49 is illustrated in FIG. 14, wherein the support bar has a round cross section and is carried by a "foot" 51 close to each end of the support bar, and resting upon the roof of the vehicle which is to carry the container and its contents. The support bar is anchored to the vehicle by means of a strap 53 which terminates in a hook 55 that in turn grips the rain gutter 57 of the vehicle and thus restrains the support bar against motion away from the vehicle.

Figure 13:
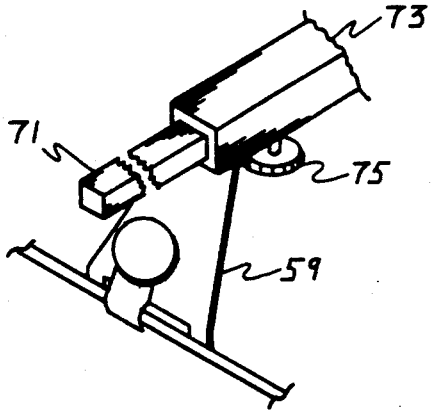
FIG. 13 is a perspective view of one end of one support bar, showing the way in which it may be carried by being anchored to the rain gutter of the vehicle upon which the portable shelter assembly is mounted.

If the vehicle does not have a rain gutter, an arrangement such as that of FIG. 13 may be employed. In that configuration, a tongue member 59 terminating in a broad hook connects the support bar to the vehicle by being locked in place between the door and door frame of the vehicle. In other words, tongue 59 hooks under the door frame rather than under a rain gutter as in the configuration of FIG. 14.

Figure 15:
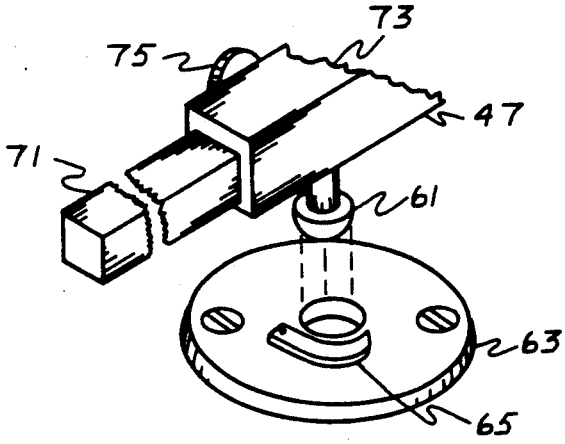
FIG. 15 is a perspective view of one end of a support bar of rectangular cross section, showing clearly the way in which the support bar may "telescope" to extend its length and showing also one mode of anchoring the support bar to a "foot" which is in turn attached to the roof of the vehicle.
Figure 16:
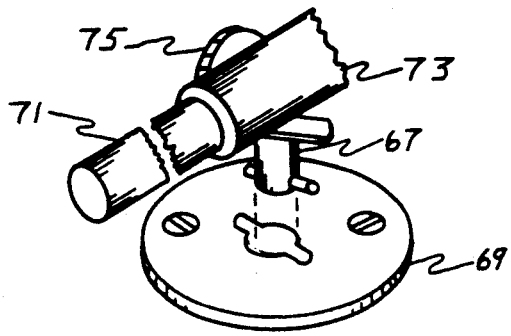
FIG. 16 is a perspective view of one end of a support bar, of circular cross section in contrast to the rectangular cross section of the bar of FIG. 15, and showing the support bar anchored to a foot on the roof of the vehicle by a "bayonet-type" connection.

If, for some reason, it is not practical or not desired to secure the support bars to either a rain gutter or door frame, the support bars may be secured directly to the roof of the vehicle by providing "shoes" which are secured to the roof and which receive a projection from the lower surface of the support bars. Such configurations are illustrated in FIGS. 15 and 16 of the drawings. In FIG. 15, a hemispherical projection 61 from the lower surface of the support bar is received by a recess in a shoe 63, fastened to the roof of the vehicle. The hemispherical projection may be retained in place by means of a locking member 65 which pivots upon the surface of shoe 63 as illustrated in FIG. 15. When hemispherical projection 61 is in place in the recess of shoe 63, locking member 65 pivots in order to retain hemispherical projection 61, thereby stabilizing the whole end of the support bar to which hemispherical projection 61 is attached. In the configuration of FIG. 16, on the other hand, a bayonet connection 67 replaces hemispherical projection 61 of FIG. 15, and may be locked in place in shoe 69 by rotating the bayonet connection after it has been inserted through the recess in shoe 69.

First support bar 47 and second support bar 49 may be chosen from a number of different sources. Suitable manufacturers are likely to be those which specialize in making and marketing ski racks and racks for carrying boats and bicycles atop vehicles. One such marketer is Thule, a unit of Eldon Group America Inc. of Elmsford, New York. Thule emphasizes support bars having a rectangular cross section as in FIGS. 13 and 15 of the drawings. Another such marketer is Yakima of Arcate, California, which sells a product line comparable to that of Thule. However, the Yakima line of support bars features a circular cross section rather than a rectangular cross section. Whatever the source of the support bars, it is desirable that they be extensible at each end, as illustrated in FIGS. 13 through 16 of the drawings.

Figure 7:
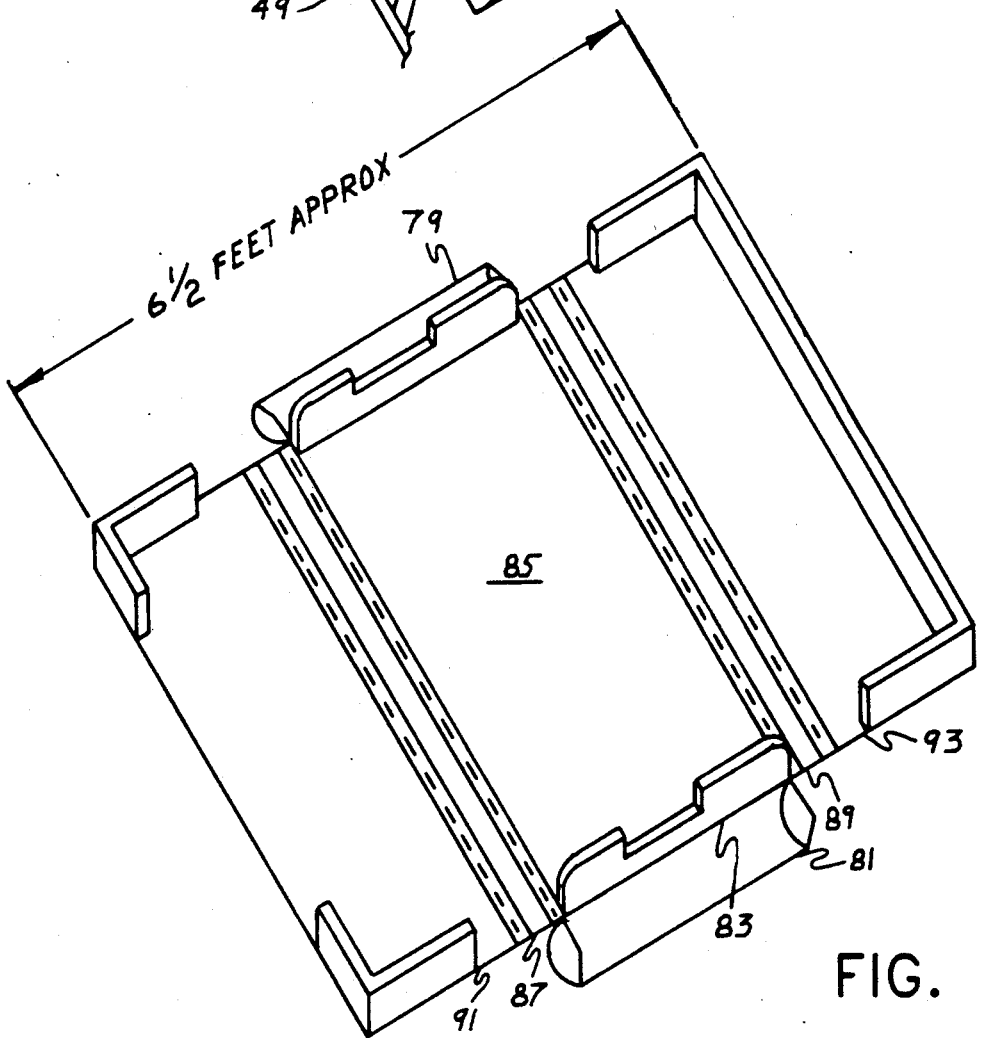
FIG. 7 is a perspective view of the container in its open position showing clearly the central floor portion of the container, the pair of side portions, and the pair of upper portions of the container in their coplanar position, and also showing the pair of curved fairings which close the respective ends of the container when the shelter assembly is in transit.

The portable shelter assembly according to my invention is intended to accommodate two persons for sleeping purposes. The assembly is designed in such a way as to be suitable for two persons to lie side by side on the deck of the container with their bodies oriented transversely of the longitudinal axis of the vehicle. For this purpose, approximately 6½ feet of length should be provided in the direction transverse to the axis of the vehicle. That is to say, the dimension of the deployed components of the container when they are oriented in their coplanar position should total about 6½ feet as illustrated in FIG. 7 of the drawings. In order to provide support for a full 6½ feet of "deck," the support bars should be longer than the conventional ski-carrier bars by about 3 feet. To this end, it is desirable that the support bars be extensible at each end by approximately 18 inches. Such extensibility is illustrated in the telescoping configurations of support bar shown in FIGS. 13 through 16 of the drawings. In each case, an inner portion 71 extends from within an outer portion 73 in a movable fashion so as to be able to extend the length of the outer portion by about 18 inches. When inner portion 71 has been set in position either in its extended or its retracted state within outer portion 73, it may be retained in place by a set screw 75. It will be understood that FIGS. 13 through 16 are provided for the purpose of illustrating the features of extensibility of the support bars and of the way in which they can be secured to the carrying vehicle. Still other modes of obtaining extensibility and stability may be employed without departing from the scope of the invention.

Figure 4:
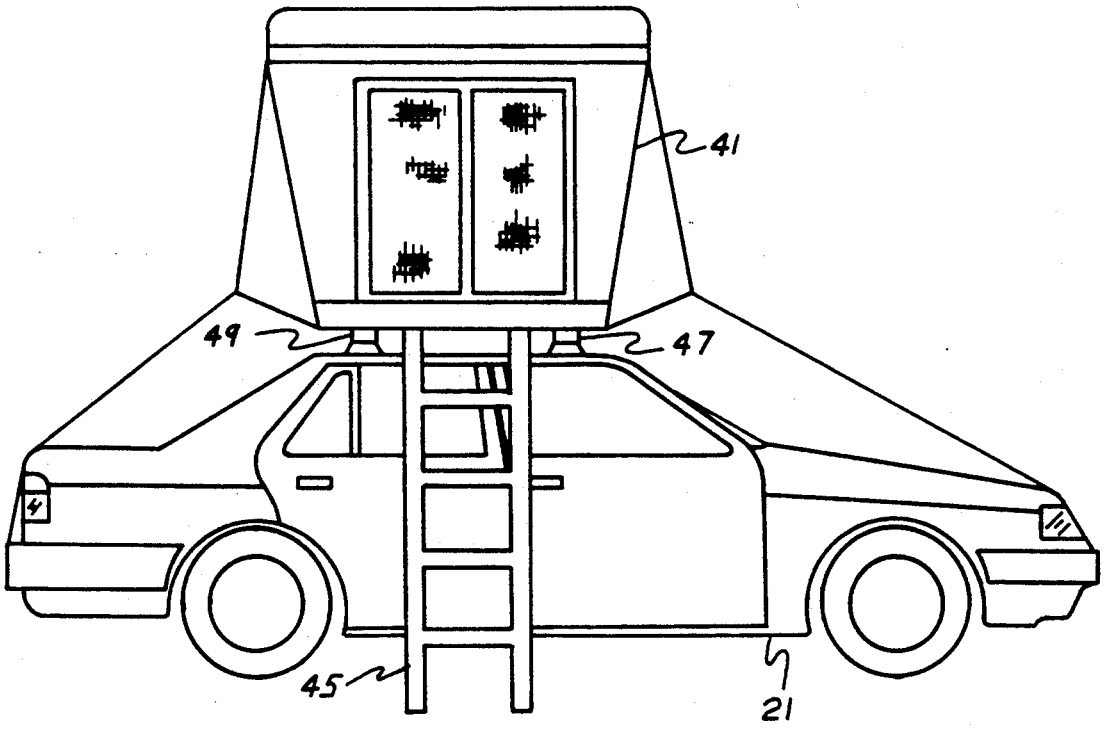
FIG. 4 is a side view of the motor vehicle with the tent in its erected position atop the motor vehicle and also showing clearly a ladder which may provide access to the tent in its erected position.
Figure 5:
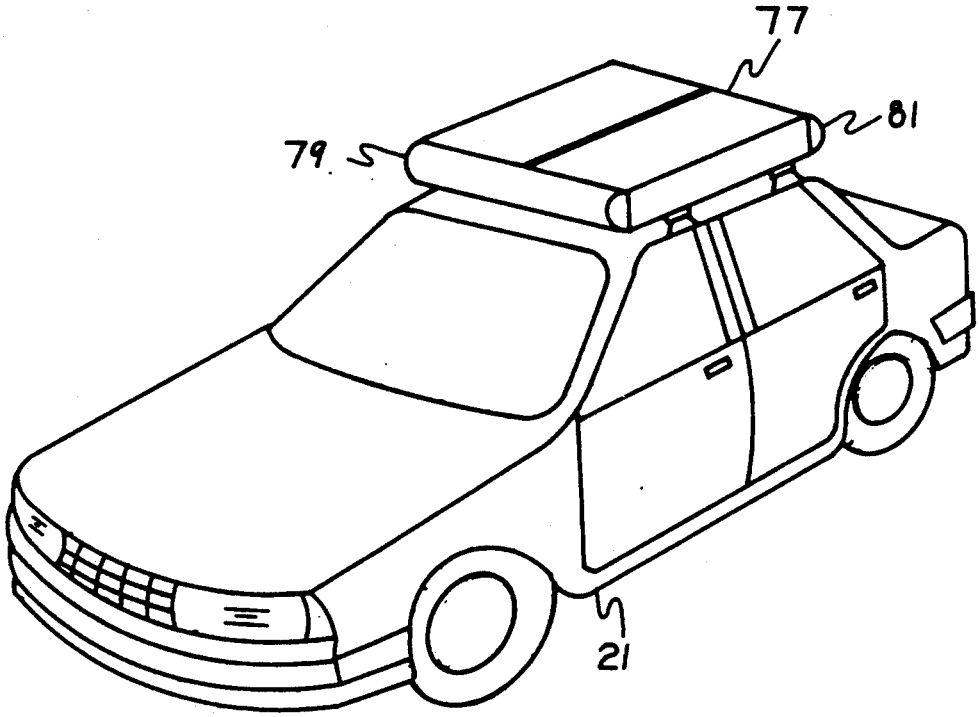
FIG. 5 is a perspective view of the motor vehicle with the container mounted atop the motor vehicle as it would be deployed when the motor vehicle is in transit. This view illustrates the "aerodynamically clean" and pleasing appearance of the container in which the tent canopy is folded when not in use.

In order to provide sufficient stability to the container, first support bar 47 should be spaced as far from second support bar 49 on the roof of the vehicle as is reasonably possible. FIGS. 4 and 5 of the drawings illustrate a spacing which would be suitable and typical for the practice of my invention. Although the container is to be secured as tightly as possible to the vehicle, there may be some small amount of "pitch" by the container with respect to the vehicle. This would involve a very slight degree of rotation of the container about a transverse axis of the vehicle and hence about the axes of first support bar 47 and second support bar 49. From this standpoint, the advantage of support bars of a round cross section is apparent. The same degree of contact between the container and a support bar of round cross section will be maintained, whereas the degree of contact between the container and a support bar of rectangular cross section would change somewhat with the slight amount of pitch of the container with respect to the vehicle. At some points, the container might be resting on the sharp corner edge of the rectangular support bar, a condition which is not desirable.

As has been mentioned, one of the objectives of the invention is to provide for the portable shelter assembly a container which is easily transportable and which is pleasing in appearance while concurrently being "aerodynamically clean" and low in aerodynamic drag. FIG. 5 of the drawings illustrates a favored configuration of container 77, mounted atop vehicle 21 in position for the vehicle to travel. It will be understood that tent canopy 23 and screen house 31 are furled within container 77 when the vehicle and container are in transit. As will become more apparent from the discussion of FIGS. 6 and 7 of the drawings, the line where the folding portions of container 77 come together is centered above and parallel to the longitudinal axis of vehicle 21. This centering of the container contributes to the good balance which has been mentioned as one of the important features of the invention. Reference to FIG. 5 also calls to attention a front curved fairing 79 and a rear curved fairing 81, which are hinged to container 77 to close respectively its front and rear ends when the container and vehicle are to be in transit.

Figure 6:
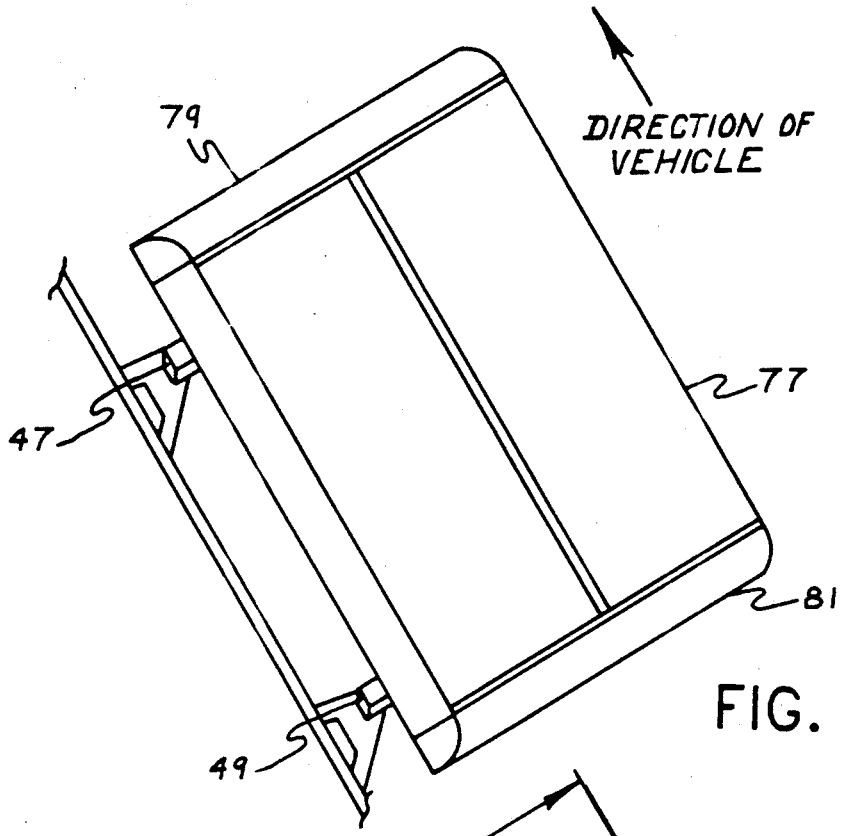
FIG. 6 is a perspective view of the container mounted atop a pair of support bars anchored to the motor vehicle, the container being closed for transit of the motor vehicle.

The configuration of the fairings is apparent in FIG. 6 of the drawings, wherein the direction of motion of the vehicle is as shown by the arrow in the figure. Accordingly, front curved fairing 79 is the "leading" fairing, whereas rear curved fairing 81 is the "trailing" fairing. The cross section of each of the fairings is part of a cylindrical shell, limited to somewhat more than one-quarter of the full cylindrical shell. Each fairing has a pair of end members, each in a plane normal to the axis of the cylindrical shell. When container 77 is opened in order to provide a base for the erection of tent canopy 23, the various portions of container 77 are oriented in a coplanar fashion as shown in FIG. 7 of the drawings. When container 77 is open, as illustrated in FIG. 7, front curved fairing 79 and rear curved fairing 81 have been rotated from their "aerodynamic" positions to permit the unfolding of the various portions of container 77. Before tent canopy 23 is erected upon the "deck" formed by container 77, it is desirable to rotate front curved fairing 79 and rear curved fairing 81 back into positions such that they will be within the tent canopy in its erected configuration. In that way, the curved fairings serve as convenient containers within the canopy and also press the canopy outward, tending to keep it taut.

FIG. 7 of the drawings illustrates container 77 in its "deployed" state, in contrast to FIG. 6, which shows container 77 in its closed state, as in transit. Illustrating the components of container 77 in their "deployed" state, FIG. 7 shows first a central floor portion 85 which rests upon and is supported by first support bar 47 and second support bar 49, whether container 77 is in the closed or deployed state. Hingedly connected to central floor portion 85 are a first side portion 87, on one side of central floor portion 85, and second side portion 89, on the other side of central floor portion 85. Similarly, FIG. 7 shows a first top portion 91 hingedly connected to first side portion 87, and a second top portion 93 hingedly connected to second side portion 89. It should be borne in mind that the direction of each of the aforementioned hinged connections is parallel to the fore- and-aft axis of container 77 and of vehicle 21. FIG. 7 of the drawings shows partial walls around the various portions of container 77 illustrated in that figure. In the representation of the partial wall around first top portion 91, there is a gap which does not find a counterpart in the representation of the second top portion 93. The reason for the existence of the gap is to provide easy access for the occupants of the tent canopy to the "deck" formed by central floor portion 85, first and second side portions 87 and 89, and first and second top portions 91 and 93 of container 77 when disposed in coplanar fashion to receive tent canopy 23 thereover. The gap through the partial wall of first top portion 91 would appear on the left-hand side of the vehicle in accordance with the orientations represented in FIGS. 1 and 2 but on the right-hand side of the vehicle in FIGS. 3 and 4. The width of first side portion 87 and second side portion 89 is such that, when container 77 is in its closed position, partial walls of first top portion 91 and second top portion 93 will be juxtaposed with the partial walls at the respective ends of central floor portion 85 and will be in close contact therewith so that there is no angular or spatial gap therebetween.

Figure 12:
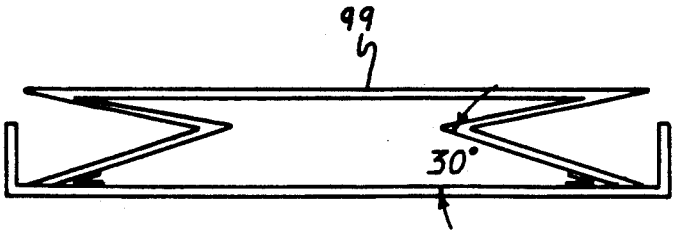
FIG. 12 is a sectional view of the folding arch member in which it is more nearly in the "nested" position and wherein the legs of the arch member form angles of approximately 30° with the central floor portion of the container.

Turning to FIG. 8 of the drawings, we find the deployed deck, formed by the various portions of container 77 and represented in FIG. 7 of the drawings, further fitted out with the structural members which are to support tent canopy 23 in its erected state. Those structural members include a first arch member 95, pivotally connected to central floor portion 85, a second arch member 97, likewise pivotally connected to central floor portion 85 at its opposite side, and a folding arch member 99 hingedly connected to central floor portion 85 midway intermediate first arch member 95 and second arch member 97. The respective legs of folding arch member 99 have "knee joints" located approximately at the mid-points of the respective legs so that the folding arch member can "nest" against central floor portion 85 of container 77, on the one hand, or can be extended into its erected position in which the legs of folding arch member 99 are straight, as shown in FIG. 8 of the drawings. For the sake of stability, and resistance against rotational movement about an axis connecting the hinge points of the respective leg portions of folding arch member 99, it is preferable to form folding arch member 99 from dual parallel arrangements of rigid material such as aluminum tubing. In accordance with the principles of my invention, folding arch member 99 should be capable of "nesting" motions as depicted in FIG. 12 of the drawings, but should be incapable of substantial rotational motion about any axis parallel to the hinges which join the various portions of container 77, as shown in FIG. 8.

In contrast to the restricted motion of folding arch member 99, first arch member 95 and second arch member 97 are permitted to rotate about pivotal connections so as to move between "nested" positions substantially parallel and adjacent to central floor portion 85 of container 77 and erected positions of the arch members as illustrated in FIG. 8. Rotation of first arch member 95 and second arch member 97 outwardly beyond the positions shown in FIG. 8 is restrained by tent canopy 23, which is to be deployed over the arch members and which prevents further divergence of the arch members beyond the positions shown in FIG. 8.

Turning to FIG. 9 of the drawings, we find a representation of the structural members of the portable shelter assembly in which the various arch members are shown in a somewhat more "robust" form than in FIG. 8 of the drawings. This somewhat more "robust" representation allows depiction of a telescoping action of first arch member 95 and second arch member 97 at the points respectively represented by the reference numerals 101, 103, 105, and 107. At those points, it is desirable for the remote portions of first arch member 95 and second arch member 97 to telescope into respective proximate portions of the arch member having a larger diameter than the remote portions. By spring loading the proximate portions of the respective arch members, it becomes possible to force the remote portions into the respective proximate portions for rotation of first and second arch members 95 and 97 and nesting close and parallel to central floor portion 85 preparatory for stowing of the structural members. On the other hand, when the arch members are to be erected to provide support to tent canopy 23, the spring loadings in the respective proximate portions of first and second arch members 95 and 97 respectively urge the remote portions upward into positions of maximum extension whereby the fabric of tent canopy 23 is drawn taut and the room within the tent canopy is maximized.

Provision is likewise made for the nesting of folding arch member 99 above and slightly spaced from central floor portion 85 of container 77 when the portable shelter assembly is being prepared for transit. This nesting of folding arch member 99 is facilitated by the provision of "knee hinges" 109, 111, 113, and 115, as shown in FIGS. 8 and 9 of the drawings. These knee hinges 109 through 115 are installed at the mid-points of the respective upright legs of folding arch member 99. As shown in FIGS. 8 and 9, it is desirable that folding arch member 99 comprise a pair of dual upright legs and a cross member which is likewise dual in structure. This duality of structure gives some rigidity against rotation of folding arch member 99 about an axis in central floor portion 85 parallel to the longitudinal axis of vehicle 21. Unlike first arch member 95 and second arch member 97, which are permitted to rotate about respective axes parallel to the longitudinal axis of vehicle 21, folding arch member 99 should not have that freedom of rotation. Rather, the nesting of folding arch member 99 is accomplished by means of knee hinges 109 through 115, which permit folding the upright legs of folding arch member 99 without rotating them about an axis parallel to the longitudinal axis of vehicle 21.

Knee hinges 109 through 115 should preferably be spring loaded, whereby the upright legs of folding arch member 99 are urged into their vertical positions in which those legs are straight. On the other hand, the spring loading in knee hinges 109 through 115 should not be so "stiff" that folding arch member 99 cannot be "collapsed" to nest within a few inches of central floor portion 85 of container 77 when the portable shelter assembly is being prepared for transit. In place of spring-loaded knee hinges 109 through 115, it would be possible to employ simple hinges, but concurrently to bias the upright legs of folding arch member 99 with elastic "bungee cords" to urge them into vertical positions. Simple hinge members are provided at the bases of the respective upright legs of folding arch member 99. Similarly, simple hinges are provided at the upper extremities of the upright legs of folding arch member 99, where they are hingedly joined to the cross member of folding arch member 99.

Figure 10:
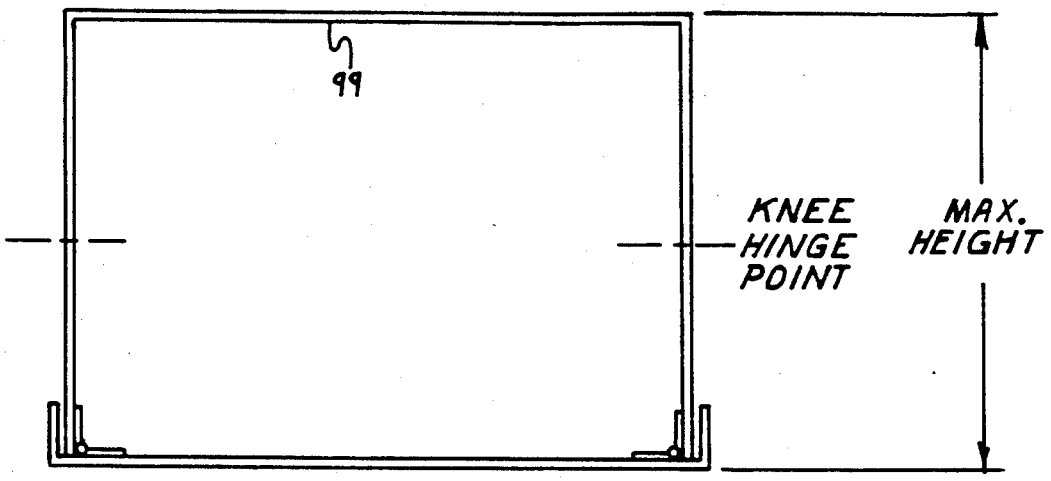
FIG. 10 is a sectional view of the aforementioned folding arch member in its fully erected position.
Figure 11:
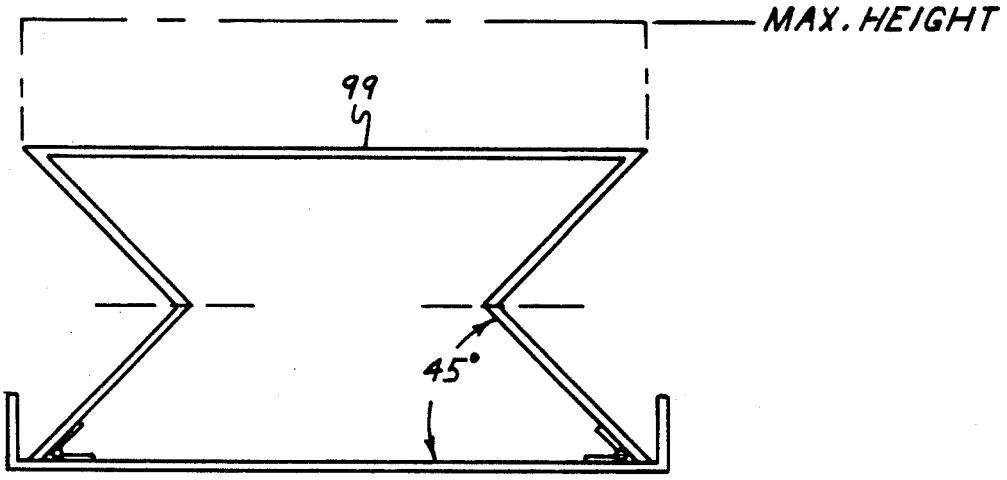
FIG. 11 is a sectional view of the aforementioned folding arch member in which it is in an intermediate position so that the "legs" of the arch member form angles of approximately 45° with the central floor portion of the container.

FIGS. 10 through 12 of the drawings are in effect "snapshots" of folding arch member 99 in three different positions with respect to its folding and erection. FIGS. 10 through 12 are all elevation views of folding arch member 99 taken in a direction normal to and displaced upwardly from the longitudinal axis of vehicle 21, upon which the portable shelter assembly is assumed to be mounted.

In FIG. 10, folding arch member 99 is shown fully erected. In that position, knee hinges 109 through 115 will have urged folding arch member 99 into a position such that its upright legs are straight and oriented perpendicularly to central floor portion 85 of container 77 throughout the lengths of the aforementioned upright legs. In FIG. 11, on the other hand, folding arch member 99 has been partially collapsed so that portions of its "upright" legs form angles of approximately 45° with central floor portion 85. In FIG. 12, the "collapsing" of folding arch member 99 has progressed further, so that the respective portions of folding arch member 99 other than the cross member form angles of approximately 30° with central floor portion 85 of container 77. In the ultimate condition of the nesting of folding arch member 99, all portions of that member will be within a few inches of central floor portion 85 of container 77. Then the container may be closed by rotating first side portion 87, second side portion 89, first top portion 91, and second top portion 93 about respective axes parallel to the longitudinal axis of vehicle 21 to form the "cover" of container 77, in which tent canopy 23 and, if desired, screen house 31 are accommodated.

In the practice of my invention, an opportunity exists for considerable flexibility in choice of materials to be incorporated into the portable shelter assembly. For tent canopy 23, I prefer to use a light but durable nylon fabric which is strong enough to withstand the pressures and stresses of stormy weather, but which is porous enough to "breathe" and permit some circulation of air therethrough. Similar comments apply to the structural portion of screen house 31. On the other hand, the material for first screened window 37 and second screened window 39 may be a netting formed from nylon or some other substance which is not subject to rot or decay, and which is preferably not very absorptive of water. The "pitch" of the filaments of the netting should be chosen so as to exclude all insects and other pests but not to impede unnecessarily the through passage of fresh air.

The material for first arch member 95, second arch member 97, and folding arch member 99 can preferably be aluminum. However, at somewhat higher cost, stainless steel may be employed. A common type of laminated panel structure may be employed in central floor portion 85, first side portion 87, second side portion 89, first top portion 91, and second top portion 93 of container 77. For this purpose, I prefer to employ a laminate in which the main structural material is aluminum formed into a corrugated configuration which, if viewed from one end thereof, appears to be a series of trapezoids, side by side, to form a plane having appreciable thickness but very little solid content other than the array of successive aluminum trapezoids. Such an array of side-by-side trapezoids can be faced with a fiberglass-reinforced-plastic sheet which is bonded to one face of the array of trapezoids and which renders that side of the array waterproof and weatherproof. If such a laminate is employed in the practice of my invention, the fiberglass-reinforced-plastic surface would be the surface which is the upper portion of the deck formed when container 77 is unfolded, and which is the inner surface of that container when it is in its closed condition. By using such a structural sandwich or laminate of aluminum trapezoids and reinforced-plastic facing, it is possible to pass the respective axles of first arch member 95 and second arch member 97 through the recesses formed by the trapezoids of the laminate or sandwich. Such passage of the axles through the openings formed by the trapezoids makes it unnecessary to have axles which are either above or below the deck surface formed by the various portions of container 77. Such axles, if they were external to the sandwich or laminate, would interfere with the use and performance of container 77 and of the portable shelter structure.

The foregoing specification has spelled out in detail the preferred mode, configuration, and materials for the practice of my invention. So far as I am aware at this time, the disclosure of the specification fully explains the "best mode" for practice of the invention. However, I realize that certain variations thereof may be made by others in the future without departing from the scope of my invention. Accordingly, the following claims define with particularity the scope of my invention which, with its equivalents, is covered by this application and any patent or patents to be granted thereon.

What I claim as new and desire to secure by Letters Patent of the United States is:

1. A portable shelter assembly comprising:

(a) a substantially rectangular container adapted to be mounted horizontally atop a vehicle, said container having a central floor portion and first and second side portions respectively hingedly connected to first and second opposite edges of said central floor portion, said first and second side portions in turn having respectively first and second top portions hingedly connected thereto and adapted to form an upper closure surface of said substantially rectangular container above and spaced from said central floor portion, said first and second side portions and said first and second top portions being also adapted to rotate about said respective hinged connections to form, together with said central floor portion, a deck in which said central floor portion, said first and second side portions, and said first and second top portions are all substantially coplanar;

(b) first and second arch members pivotally connected to said central floor portion so as to be rotatable into erected positions forming obtuse angles with said central floor portion when said first and second side portions and said first and second top portions are in the aforementioned coplanar position;

(c) a folding arch member hingedly attached at its respective ends to third and fourth opposite edges of said central floor portion and erectable from a folded position adjacent said central floor portion to provide a supporting structure intermediate said first and second arch members when they are in their erected positions; and (d) a weatherproof tent canopy adapted to be supported by said first and second arch members in their erected positions and by said folding arch member in its erected position, opposite ends of said weatherproof tent canopy being secured on the extremities of said first and second top portions when in their coplanar positions.

2. A portable shelter assembly in accordance with claim 1, further including first and second end fairings respectively hinged to said third and fourth opposite edges of said central floor portion and adapted to rotate about said respective hinges into closed positions to weatherproof the respective opposite ends of said substantially rectangular container.

3. A portable shelter assembly in accordance with claim 1 in which said folding arch member has legs each of which is hinged near its midpoint so as to be collapsible on top of said central floor portion and erectable to support said weatherproof tent canopy.

4. A portable shelter assembly in accordance with claim 1 in which the angle between said first arch member and said first top portion and the angle between said second arch member and said second top portion are each less than ninety degrees when said first and second arch members are in their respective erected positions and when said first and second top portions are in said coplanar position.

5. A portable shelter assembly in accordance with claim 1, further including structure connectable to said deck and to said tent canopy for supporting screenwork for protection against insects.

6. A portable shelter assembly in accordance with claim 1, further including first and second partial end walls mounted respectively on said third and fourth opposite edges of said central floor portion and extending upwardly to support said first and second top portions when they are positioned to form said upper closure surface of said substantially rectangular container.

7. A portable shelter assembly in accordance with claim 6 in which the pivotal connections of said first and second arch members to said central floor portion are located outboard of said first and second partial end walls and farther from the center of said central floor portion.

8. A portable shelter assembly in accordance with claim 1, further including first and second support bars for supporting said central floor portion and also said first and second side portions and said first and second top portions when they occupy their substantially coplanar positions, said first and second support bars being spaced apart in substantially parallel array and being adapted to be mounted transversely on the top of a vehicle.

9. A portable shelter assembly in accordance with claim 8 in which said first and second support bars include telescopic means for extension of their ends.

10. A portable shelter assembly in accordance with claim 8 in which the cross sections of said first and second support bars are substantially square.

11. A portable shelter assembly in accordance with claim 8 in which the cross sections of said first and second support bars are substantially round.

12. A portable shelter assembly in accordance with claim 8 in which each of said first and second support bars has at each of its ends a foot for resting on the top of said vehicle to enable said vehicle to carry said support bars.

* * * * *